US006439681B1

(12) United States Patent
McClellan

(10) Patent No.: US 6,439,681 B1
(45) Date of Patent: Aug. 27, 2002

(54) METHOD AND APPARATUS FOR IMPROVING PRINT QUALITY ON FAILURE OF A THERMAL INK JET NOZZLE

(75) Inventor: Paul J. McClellan, Salem, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/492,263

(22) Filed: Jan. 27, 2000

(51) Int. Cl.[7] ..... B41J 2/01
(52) U.S. Cl. ..... 347/14; 347/19
(58) Field of Search ..... 347/14, 19, 40, 347/47, 42

(56) References Cited

U.S. PATENT DOCUMENTS 5,187,500 A 2/1993 Bohorquez et al. ..... 346/140 R
5,541,625 A 7/1996 Holstun et al. ..... 347/5
5,581,284 A 12/1996 Hermanson ..... 347/43
5,640,183 A * 6/1997 Hackleman ..... 347/40
5,880,758 A 3/1999 Stoffel et al. ..... 347/43
6,106,088 A * 8/2000 Wafler ..... 347/7

* cited by examiner

*Primary Examiner*—Craig A. Hallacher

(57) ABSTRACT

When a print nozzle or other firing element of an ink jet print head fails, printed image quality suffers. In a print head where there are additional printing elements that continue to work and that are adjacent the failed element, a failed firing element can be compensated for by increasing the firing rate of, or firing pulse duration to, one or more printing elements that are adjacent to the failed element. Additional ink deposited on the printing medium will bleed onto areas that are normally printed onto by the failed firing element.

19 Claims, 5 Drawing Sheets

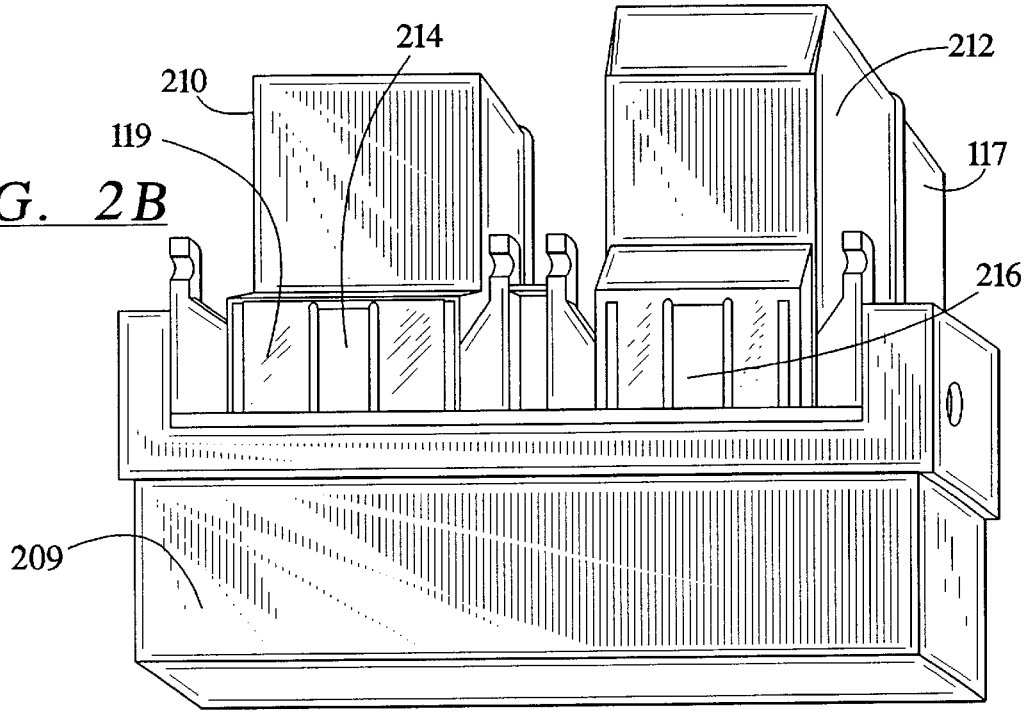
FIG. 2B
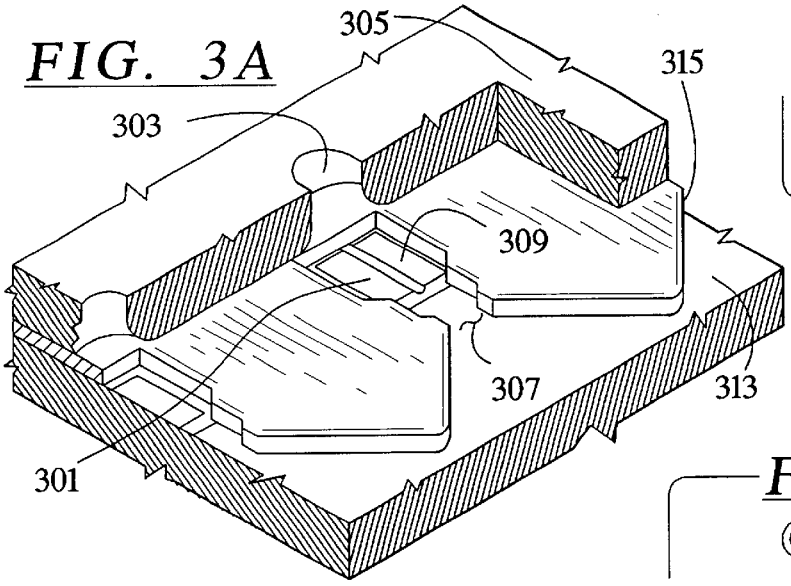
FIG. 3A
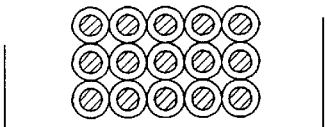
FIG. 3B
FIG. 3C
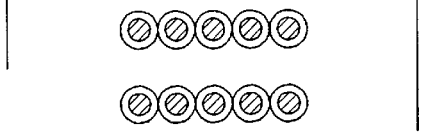
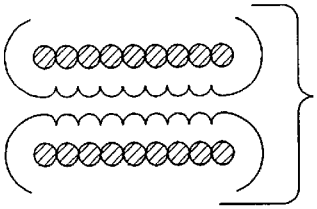
FIG. 3D

METHOD AND APPARATUS FOR IMPROVING PRINT QUALITY ON FAILURE OF A THERMAL INK JET NOZZLE

BACKGROUND OF THE INVENTION

Thermal ink jet printers have become nearly ubiquitous. These printers typically use semiconductor-based print heads that have individually-controlled printing elements that eject water-based inks onto a print media through microscopic holes under the control of a computer. Most so-called thermal ink jet (TIJ) printers use print heads that traverse a print media as ink is ejected, painting an image or text onto a page by the successive passes that the print head makes over the page.

The water-based ink that is used in most thermal ink jet printers is vaporized by heat produced by thin film resistors in the ink jet print head. While thermal ink jet printers are capable of providing consistently high quality printed output at relatively modest prices, they are not without operationally-induced short-comings. Heat and chemicals in the ink can react with metal components of the print heads.

Most thermal ink jet printers use print heads that have several individually-fired ink energizing elements. Each of the ink energizing elements causes small droplets of ink to be ejected from the print head onto a print media. When an ink energizing element fails, it can produce noticeable streaks or other anomalies in the printed output. When printing an image using a printer having an ink jet print head that traverses a page, a printing element failure is typically manifested by streaks or bands wherein color is missing.

Individual printing element failure can be caused by a variety of factors including corrosion, dried ink, or ink flow obstruction caused by particles or other impurities in the ink. When one-or more print elements fail, output print quality suffers. Discarding and replacing an ink jet printer print cartridge because individual printing elements have failed might be unnecessary if it were possible for the working print elements to compensate for the failed element. Similarly, when an ink jet printer is run in a "draft" or single-pass mode wherein the print head passes over a selected area of the print medium being printed only once, printing quality also suffers. A method and apparatus that can compensate for a failed print element in an ink jet printer print head, i.e. continue to produce acceptable-quality print output even if a print element has failed, might produce considerable savings to ink jet printer users. A method of printing with larger and/or more numerous drops might improve print quality on a printing element failure as well as improve print quality when the printer is run in so-called draft mode.

SUMMARY OF THE INVENTION

In a thermal ink jet print head that uses an array (or arrays) of individually-addressable printing elements, printed output defects or anomalies that are caused by a printing element failure can be compensated for using the printing elements that are closest to the failed element. By increasing the quantity or volume of ink that is output from printing elements that are adjacent to a failed printing element, defects in a printed image or text can be effectively hidden or masked. Increasing ink output from the printing elements that are operational, so that the ink can bleed over or migrate into the area that would normally be painted by the failed element, streaking or banding in a printed output image or text can be reduced or even eliminated.

BRIEF DESCRIPTION OF THE DRAWINGS

FIG. 2B shows two ink jet printer cartridges side-by-side in a printer carriage. One cartridge typically prints black ink; the other typically prints colors.

FIG. 3A shows an isometric cut-away view of an inverted semiconductor print head, showing one ink energizing element that includes an ink orifice, thin film ink heater resistor and ink flow channel.

FIG. 3B shows an exemplary output of three (3) working ink-energizing elements.

FIG. 3C shows an exemplary output produced when one of three ink-energizing elements fails.

FIG. 3D shows an exemplary output produced by two ink energizing elements that fire at an increased rate to compensate for a missing, i.e. a failed element.

DETAILED DESCRIPTION OF THE PREFERRED EMBODIMENT

Figure 1:
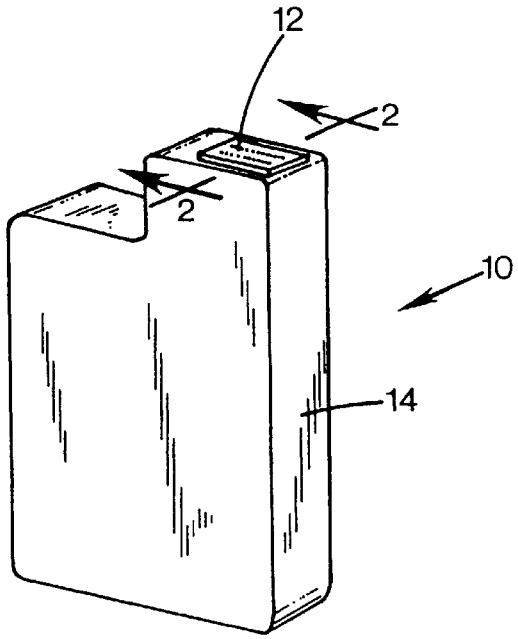
FIG. 1 shows a perspective view of a thermal ink jet printer cartridge that uses a semiconductor print head.

FIG. 1 shows an isometric or prospective view of a thermal ink jet printer cartridge 10 that uses a semi conductor print head to eject ink from the ink cartridge onto a print medium. The ink jet printer cartridge 10 includes an ink reservoir 14 in which is stored, a water based ink.

While the ink jet printer cartridge 10 that is shown in FIG. 1 is shown in an inverted orientation, when the cartridge 10 is installed into a printer, ink from the reservoir 14 flows through an ink manifold (not shown) into small recesses and chambers in the semi conductor print head 12 that include resistive heater elements that cause the water-based ink to be ejected through small orifices (not shown) formed into the print head 12 and thereafter onto a print medium.

Figure 2A:
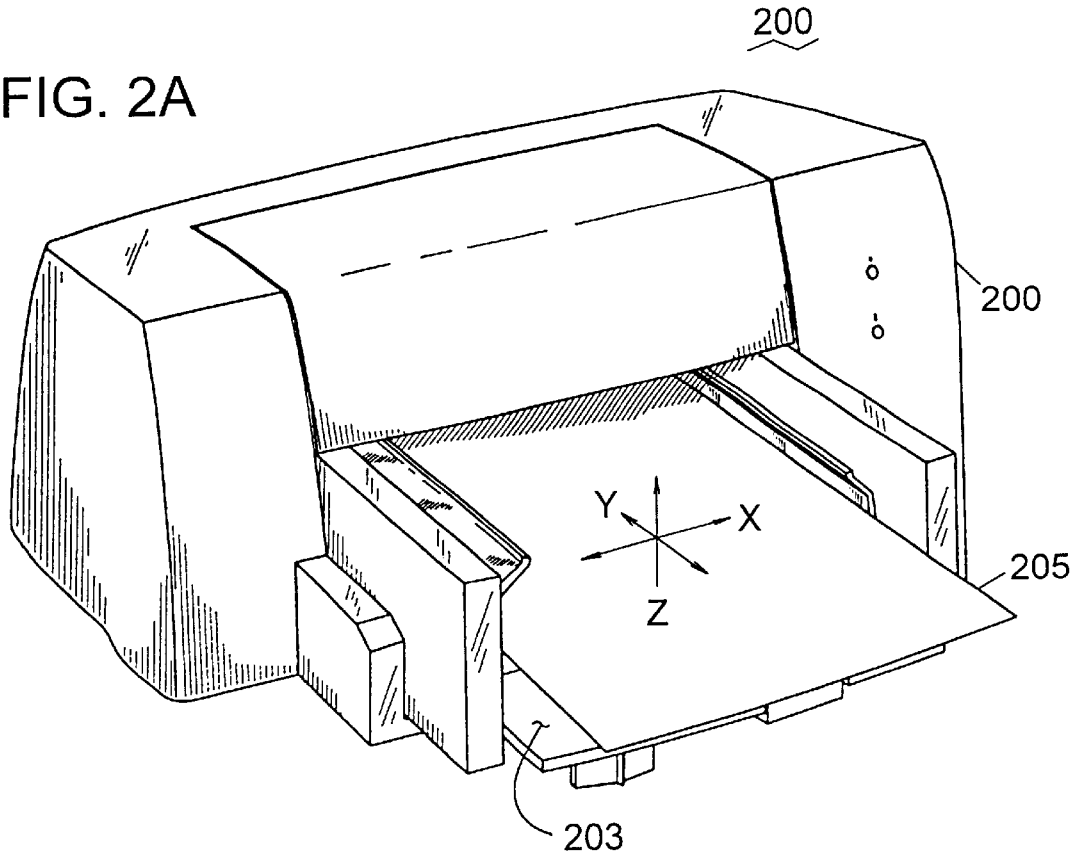
FIG. 2A shows a perspective view of an exemplary thermal ink jet printer and an output page.

FIG. 2A shows a prospective view of an exemplary thermal ink jet printer 200 that includes a paper output tray 203 into which is ejected output printed pages 205 and upon which images or text are printed using the aforementioned ink jet printer cartridge 10. The printer 200 shown in FIG. 2A is coupled to a personal computer or other appropriate controller through a cable and interface, neither of which are shown in FIG. 2A. The printer 200 typically uses a dual-printer carriage, such as that shown in FIG. 2B. The dual-printer carriage 209 carries two ink jet printer cartridges 210 and 212 side by side whereby black ink is printed from one cartridge and the cyan, magenta, and yellow inks are printed from the other cartridge through semi conductor print heads 214 and 216 that comprise part of the two printer cartridges 210 and 212 respectively.

Figure 2C:
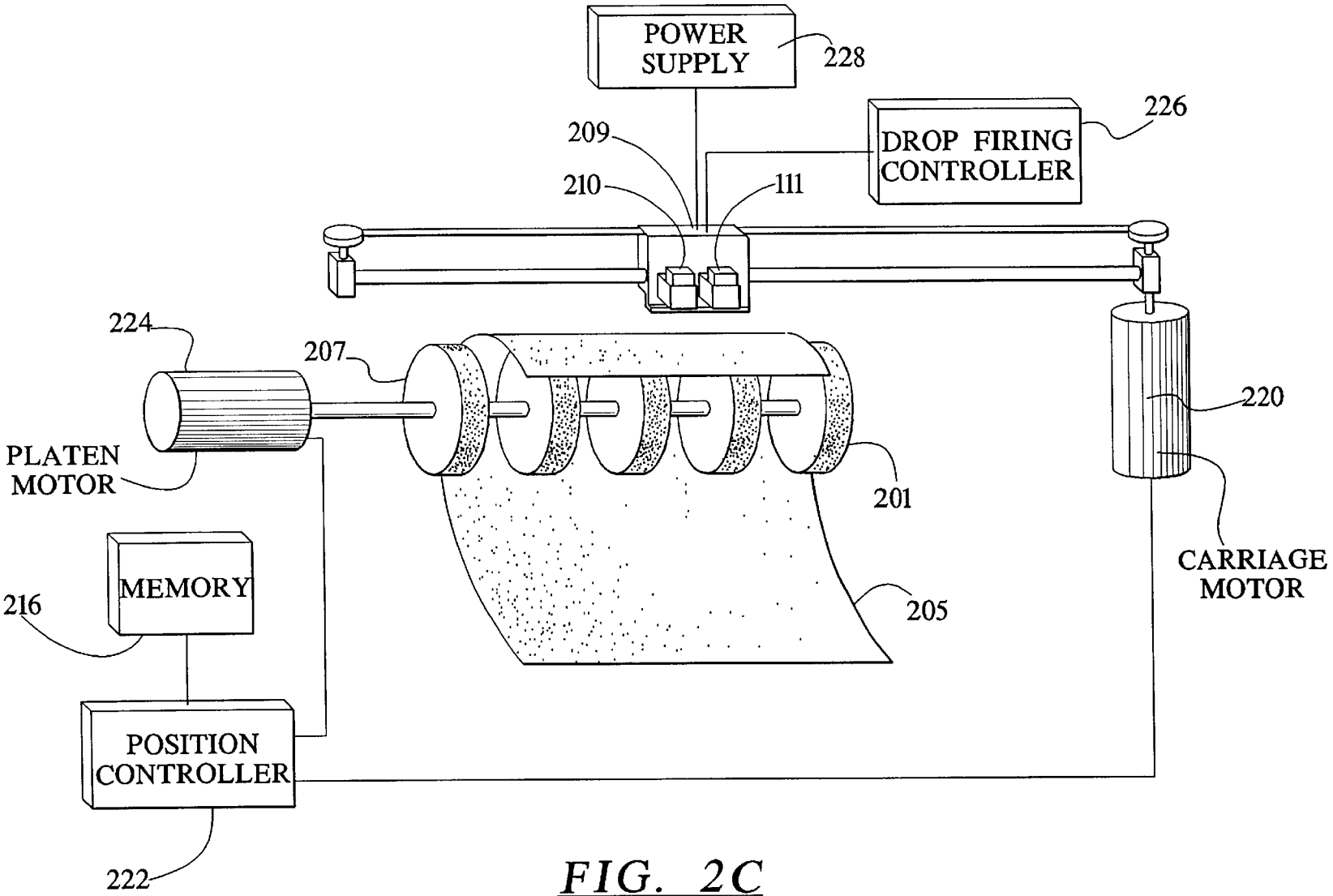
FIG. 2C is a simplified representation of the functional elements of the thermal ink jet printer shown in FIG. 2A and which are used in virtually all ink jet printers, including a printer carriage carrying two side-by-side printer cartridges.

The movement of the printer cartridges in the carriage 209 as accomplished in the printer 200 by means of a mechanism such as that shown in FIG. 2C, which is a simplified block diagram of the functional elements of a thermal ink jet printer. The printer cartridge carriage 209 that includes the two cartridges 210 and 212 is longitudinally moved across a print medium 205 under the control of a carriage motor 220 that is controlled by a position controller 222. The position controller 222 also controls a platen motor 224 which together control precisely where in the printed medium 205 ink from the cartridges 210 and 212 is deposited under the control of an ink drop firing controller 226. The ink drop firing controller 226 operates under the control of the computer controlling the printer 200 to form on the printed output page 205 text or images as required.

A power supply 228 provides electrical energy to both the printer cartridges 210 and 212 as well as the carriage motor 220 and the platen motor 224 although electrical connection to the carriage motor 220 and platen motor 224 is not shown in FIG. 2C for purposes of clarity.

The operation of a thermal ink jet printer can be understood by reference to FIG. 3 which shows a cutaway view of one ink energizing element that is part of the semi conductor print head 12 shown in FIG. 1. With respect to the inverted cutaway portion of the semi conductor-based ink energizing element 300 shown in FIG. 4 an ink orifice 303 directs vaporized water-based ink that is heated past its vapor point by thermal energy generated by a thin film resistor 301 that heats water-based ink in a volume immediately above the resistor and identified by reference numeral 309. Water-based ink flows into this ink-energizing element or firing chamber through an orifice or passage 307 that couples the ink-energizing element or firing chamber 309 to an ink manifold, not shown in FIG. 3.

Figure 5:
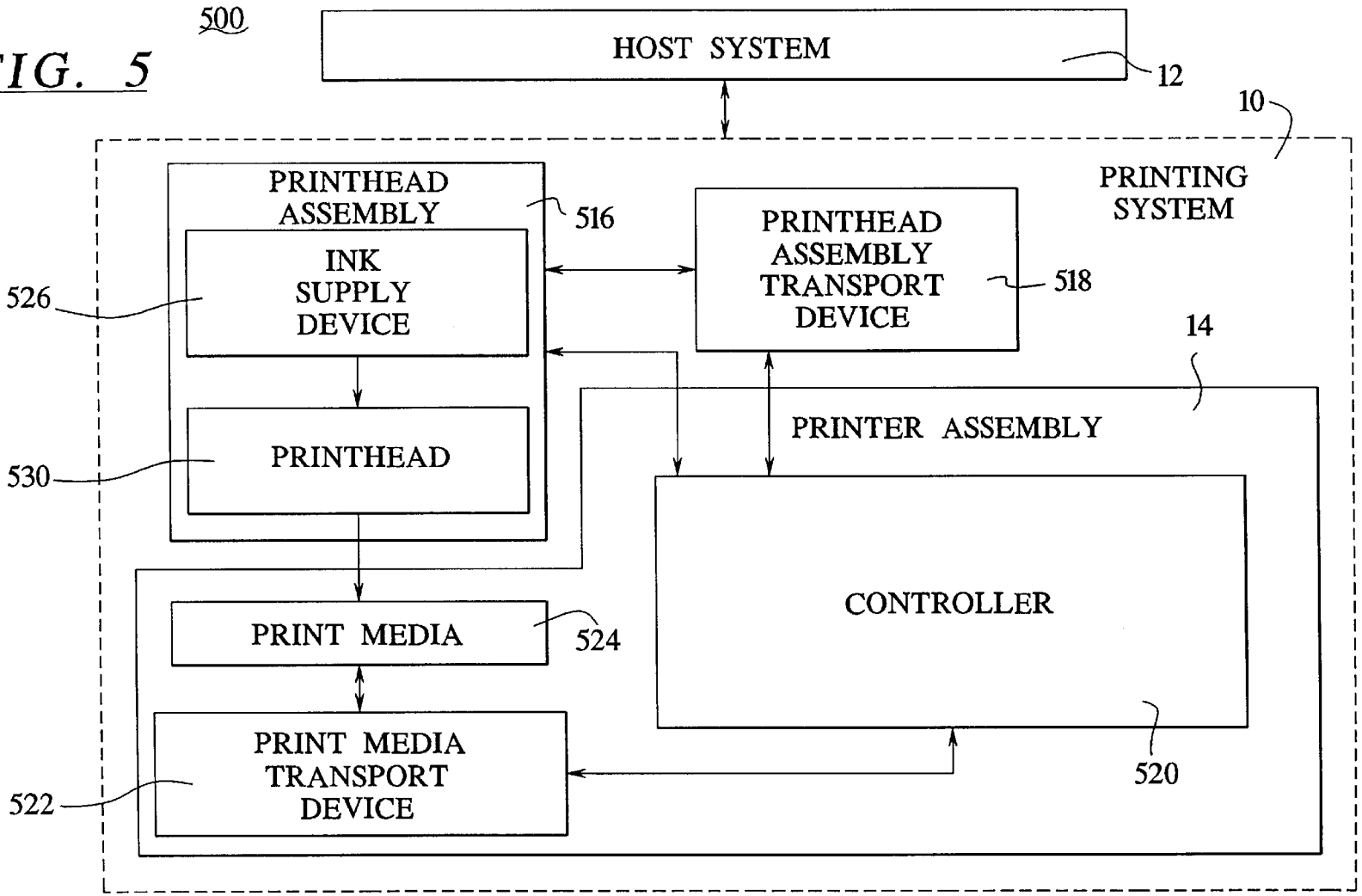
FIG. 5 shows a simplified block diagram of a controller system for the individual ink energizing elements on the semiconductor substrate.

FIG. 5 shows a simplified block diagram of a drop firing controller 500 for use with the system shown in FIG. 2C and depicted therein as the drop firing controller 226. A controller 520 directs the position of the print head assembly by signals sent to and received from a print head assembly transport device 518. The transport device 518 would generate signals informing the controller 520 of precisely where on its travel the print head transport is positioned at any given time. Signals from the transport device 518 are sent to the print head assembly 516, typically through a ribbon cable, to control where and how on the page, the print head 530 is energized to eject ink from the reservoir 526. The position of the print media 524 is controlled by the print media transport device 522 which would include the carriage motor and the platen motor but in particular the platen motor which rotates the printer wheels 201 shown in FIG. 2C to position the paper beneath the printer cartridges.

The firing element 300 shown in FIG. 3A is subject to failure from a variety of causes. Metal connections between the thin film resistor 301 and the external controller can cause the ink-energizing element to fail. Water-based inks can dry out even inside the ink-energizing element or ink chamber 309 also causing the ink-energizing element to fail. Detecting a printing element failure might be accomplished using the methodology disclosed in U.S. Pat. No. 5,646,654 for an "Ink Jet Printing System Having Acoustic Transducer for Determining Optimum Operating Energy" assigned Hewlett-Packard Company. Once an ink energizer fails, overcoming the adverse effects it causes is accomplished by the methodology disclosed herein.

FIG. 3B shows an exemplary dot pattern produced by an ink jet printer when three (3) co-linear ink-energizing elements are functioning properly. In an ink jet printer, the print head and media being printed typically move longitudinally with respect to each other. In FIG. 3A, it can be seen that three uniform rows of dots are printed along the horizontal axis of the page.

FIG. 3C shows the effect of a single failed ink-energizing element. A missing or failed nozzle between the upper and lower nozzles causes an entire row of printed dots to be lost.

FIG. 3D shows how the printed output of FIG. 3C might be improved by increased drop firing rate. At least part of the region between the upper and lower rows is painted with ink from the two functioning ink-energizing elements.

In order to overcome the adverse effects in image quality that are caused by ink energizing element failure, the individual ink energizing elements in the semi-conductor print head 12 can be fired at an enhanced rate in order to overcome the streaking and other anomalies produced when one or more of the ink energizing elements fails. Firing the ink energizing elements at an elevated rate can also produce improved print quality output when a printer is run in a "draft" mode during which the print head moves over an area being printed only once.

Figure 4:
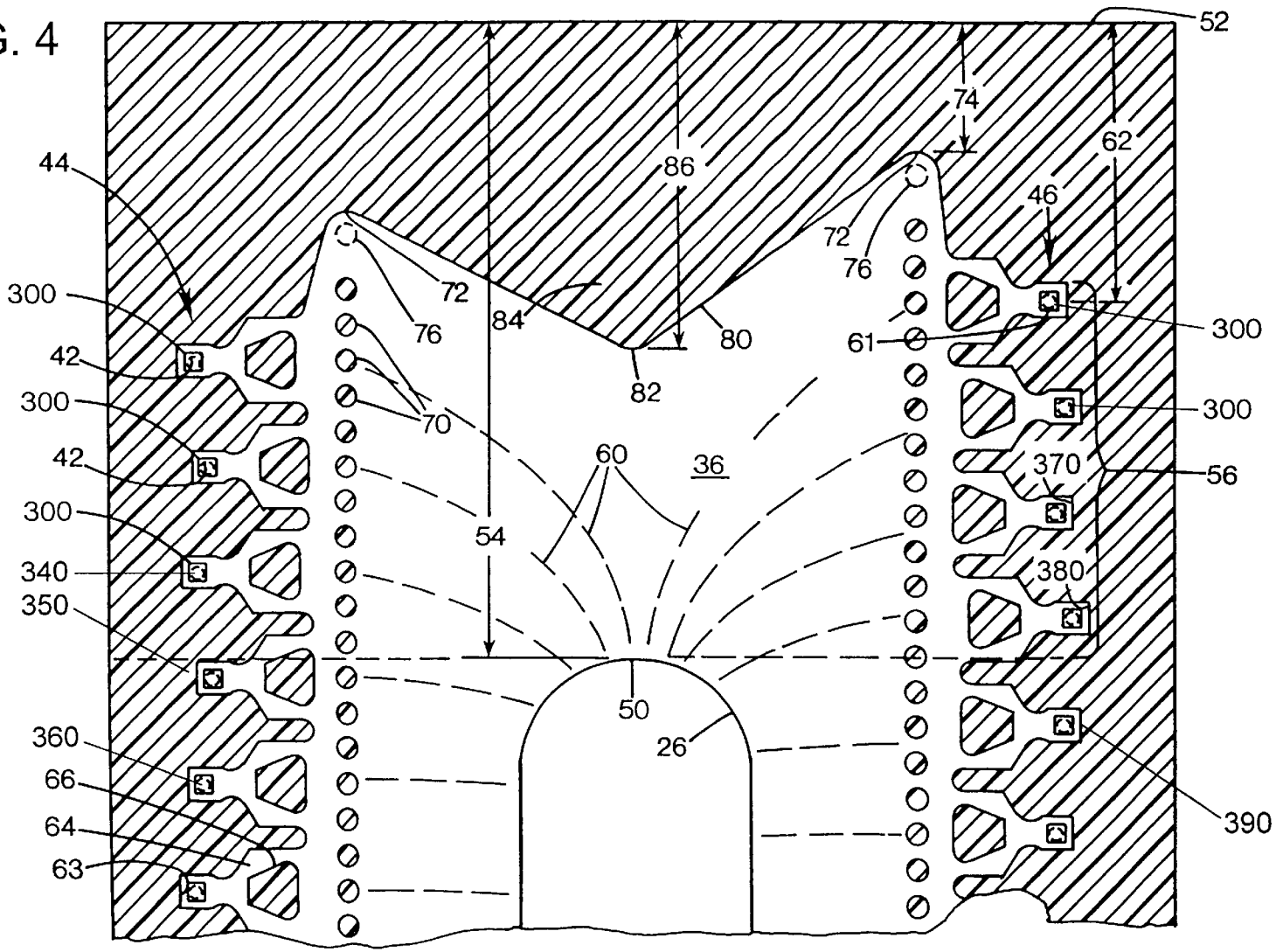
FIG. 4 shows a top or plan view of substantially one half of a semiconductor print head substrate showing the top view and placement of numerous ink energizing elements and the top view and location of an ink manifold through which ink flows from an ink reservoir.

FIG. 4 shows a top view of a portion of the semi conductor substrate or print head 12 shown in FIG. 1. Several different individual ink energizing elements 300 are arranged in an array on either side of an ink manifold 50 through which ink flows from a reservoir upward into the plane of the page and horizontally into the recesses that lead to the individual ink energizing elements 300. The actual spacing between each of the ink energizing elements is quite small, however, the effect of even a single failed element can be seen in the output, particularly in color images.

Upon the failure of an ink-energizing element 350, adjacent ink energizing elements 340, 360, 370, 380 and/or 390 can be fired at an increased rate or an increased time duration thereby causing additional ink to be deposited onto the print medium. Because the ink energizing elements are closely spaced, increasing the ink deposition of adjacent elements can at least partially overcome the adverse effect that a failed print element has on output quality. When water-based ink is applied to the print medium, it tends to migrate or flow over into the areas that would have been printed by the failed ink-energizing element 350. Increased ink output from working elements can be used to compensate for a failed element. In the preferred embodiment, ink-energizing elements that are immediately adjacent to a failed element are energized at an increased frequency producing a net result of depositing additional ink onto the print medium. An alternative embodiment would include energizing adjacent ink energizing elements for longer time periods that would also increase the amount of ink deposited onto the print medium. The increased firing rate or firing duration would be accomplished by circuitry within the drop firing controller 226 that could also be implemented by the external circuitry of a computer driving the printer 200.

While the preferred method fires adjacent elements at an increased rate, an alternate method would simply fire the working adjacent elements for longer times. In addition to this alternate embodiment, at least one other possible alternate embodiment would include firing just a single working ink energizing element, preferably adjacent to the failed element, for additional time or at an elevated frequency such that ink from the single, working element would bleed or migrate over areas that would not be "painted" by the failed element. Additional ink from at least one working element is required to compensate for a failed element.

While the preferred embodiment disclosed herein is taught with respect to a thermal ink jet printer, the invention would find equal applicability to ink jet printers that use piezoelectric or other printer elements and technology. In these alternate embodiments, the ink energizing elements might be piezoelectric devices or other mechanisms known in the image printing arts.

What is claimed is:

1. In a printer print head having a plurality of printing elements, each printing element being capable of depositing ink drops on a print medium in response to electrical firing pulses applied to said printing elements so as to produce an image thereon, a method of improving printed image quality in response to a failed printing element comprised of the steps of:

energizing at least a first printing element by an increased amount;

whereby at least some of the ink deposited on said printing medium by said first printing element migrates onto the area of said printing medium whereat said failed printing element would normally deposit ink.

2. The method of claim 1 wherein step of energizing at least a first printing element by an increased amount is comprised of the steps of: energizing a first printing element that is adjacent to said failed element on a first side of said failed element by an increased amount.

3. The method of claim 1 wherein said increased amount is comprised of an increased firing rate of electrical firing pulses to said at least one first printing element.

4. The method of claim 1 wherein said increased amount is comprised of an increased time duration of a firing pulse delivered to said at least one printing element.

5. In a printer print head having a plurality of printing elements, each printing element being capable of depositing ink drops on a print medium in response to electrical firing pulses applied to said printing elements so as to produce an image thereon, a method of improving printed image quality in response to a failed printing element comprised of the steps of:

a. energizing a first printing element by an increased amount;

b. energizing a second printing element by an increased amount;

whereby at least some of the ink deposited on said printing medium by said first and second printing elements migrates onto the area of said printing medium whereat said failed printing element would normally deposit ink.

6. The method of claim 5 wherein step of energizing a first printing element by an increased amount is comprised of the steps of energizing a first printing element that is adjacent to said failed element on a first side of said failed element by an increased amount.

7. The method of claim 6 wherein step of energizing a first printing element by an increased amount is comprised of the steps of: energizing a second printing element that is adjacent to said failed element on a first side of said failed element opposite to said first side, by an increased amount.

8. The method of claim 5 wherein said increased amount is comprised of an increased firing rate of electrical firing pulses to at least one of said first and second printing elements.

9. The method of claim 5 wherein said increased amount is comprised of an increased time duration of a firing pulse delivered to at least one of said first and second printing elements.

10. The method of claim 5 wherein said first printing element is located at a first location on a first side of said failed element and said second printing element is located at a location on a second side diametrically opposed to said first side.

11. In a printer print head having a substantially linear array of printing elements, each element depositing ink drops on a printing medium in response to electrical firing pulses applied to said printing elements to produce an image thereon, a method of improving printed image quality in response to a failed printing element comprised of the steps of:

a. energizing a first printing element adjacent to said failed element on a first side of said failed element by an increased amount;

b. energizing a second printing element adjacent to said failed element on a second side of said failed element by an increased amount;

whereby at least some of the ink deposited on said printing medium by said first and second printing elements migrates onto the area of said printing medium whereat said failed printing element would normally deposit ink.

12. The method of claim 11 wherein said increased amount is comprised of an increased firing rate of electrical firing pulses to at least one of said first and second printing elements.

13. The method of claim 11 wherein said increased amount is comprised of an increased time duration of a firing pulse delivered to at least one of said first and second printing element.

14. A printer providing an improved image quality in response to a failed first printing element in a print head, said printer comprised of:

a. a plurality of printing elements, each printing element being capable of depositing ink drops on a print medium in response to electrical firing pulses applied to said printing elements from a controller so as to produce an image on said print medium;

b. a controller, energizing a second predetermined printing element of said plurality of printing elements, by an increased amount upon the failure of said first printing element;

c. a controller energizing a third predetermined printing element of said plurality of printing elements by an increased amount upon the failure of said first printing element;

d. an ink reservoir, operatively coupled to said plurality of printing elements and providing ink thereto;

whereby at least some of the ink deposited on said printing medium by said second and third printing elements migrates onto the area of said printing medium where at said failed printing element would normally deposit ink.

15. The apparatus of claim 14 wherein said printer is a thermal ink jet printer.

16. A print head capable of producing improved-quality print images upon the failure of a printing element, said print head comprised of:

a. a substrate defining an ink aperture through which ink flows from a reservoir, said substrate further having first, second and third ink energizing elements, each of said ink energizing elements being configured and operative to deposit ink onto print media;

b. an ink reservoir, operatively coupled to said first and second printing elements by which ink flows to said ink energizing elements, for placement onto a printing medium;

c. means for firing said first and second ink energizing elements at an increased rate upon the failure of said third ink energizing element.

17. The print head of claim 16 wherein said means for firing includes a computer.

18. The print head of claim 16 wherein said means for firing is comprised of a computer that operates to fire said first and second ink energizing elements at an increased frequency such that ink from said first and second ink energizing elements migrates onto print media otherwise unprinted because of said failed third ink energizing element.

19. The print head of claim 16 wherein said means for firing is comprised of a computer that operates to fire said first and second ink energizing elements for an increased time duration.

* * * * *